US010383428B2

(12) United States Patent
Alexis

(10) Patent No.: US 10,383,428 B2
(45) Date of Patent: Aug. 20, 2019

(54) INTERIOR SLEEVE FOR HOLDING EYEWEAR

(71) Applicant: Garnett E. Alexis, New Haven, CT (US)

(72) Inventor: Garnett E. Alexis, New Haven, CT (US)

( * ) Notice: Subject to any disclaimer, the term of this patent is extended or adjusted under 35 U.S.C. 154(b) by 430 days.

(21) Appl. No.: 14/980,004

(22) Filed: Dec. 28, 2015

(65) Prior Publication Data

US 2017/0181531 A1 Jun. 29, 2017

(51) Int. Cl.
*A45F 5/02* (2006.01)
*A41B 1/18* (2006.01)

(52) U.S. Cl.
CPC . *A45F 5/02* (2013.01); *A41B 1/18* (2013.01)

(58) Field of Classification Search
CPC ..... A45F 5/02; A41B 1/18
See application file for complete search history.

(56) References Cited

U.S. PATENT DOCUMENTS 3,242,502 A * 3/1966 Geist ..... A41D 27/20 2/253
3,374,508 A 3/1968 Slimovitz
4,062,064 A 12/1977 Vosatka
4,896,377 A 1/1990 Ferdi
4,969,239 A 11/1990 Bruno
5,119,979 A 6/1992 Kallman
5,584,074 A 12/1996 Battle-Smtih
5,903,928 A 5/1999 Hyung-Seob
6,237,159 B1 5/2001 Martin
7,487,574 B2 2/2009 Lee-Holowka et al.
7,621,001 B2 11/2009 Ebihara
7,721,392 B2 5/2010 Avery
D691,348 S 10/2013 Glaze
8,898,816 B2 12/2014 Highfield
9,192,199 B1 11/2015 Lodza
2003/0154534 A1 8/2003 Miller et al.
2004/0025216 A1 2/2004 Marogil
2005/0235398 A1 10/2005 Yoo
2006/0075537 A1 4/2006 Tsai
(Continued)

FOREIGN PATENT DOCUMENTS

CN 202190755 U 4/2012
WO 2016111864 A1 7/2016

OTHER PUBLICATIONS

International Search Report and Written Opinion Application No. PCT/US2016/066122 dated May 5, 2017 11 pages.

*Primary Examiner* — Anna K Kinsaul
(74) *Attorney, Agent, or Firm* — Murtha Cullina LLP

(57) ABSTRACT

Disclosed is an article of clothing for holding eyewear and method of use thereof. The clothing article has interior and exterior sides. A sleeve is located on the interior side and extends from an opening, the opening is configured to receive a part of the eyewear. A first section of the sleeve extends from the opening towards a first end at first distance and in a first direction. A second section of the sleeve extends from the first end a second distance and in a second direction with the second direction positioned at an angle relative to the first direction. The sleeve is configured to retain the part of the eyewear therein to hold the eyewear to the article of clothing and the sleeve is narrower than the lens height of the eyewear.

10 Claims, 5 Drawing Sheets

(56) References Cited

U.S. PATENT DOCUMENTS

| | | | | |
|---|---|---|---|---|
| 2006/0152671 | A1 | 7/2006 | Risso et al. | |
| 2007/0124846 | A1 | 6/2007 | Mosley | |
| 2007/0250980 | A1* | 11/2007 | Pellerin | A41B 9/02 2/69 |
| 2008/0127460 | A1 | 6/2008 | Severen et al. | |
| 2012/0096628 | A1 | 4/2012 | Grady | |
| 2014/0189927 | A1 | 7/2014 | Kidman | |
| 2014/0215763 | A1 | 8/2014 | White | |
| 2014/0259270 | A1 | 9/2014 | Lepovitz | |
| 2015/0157074 | A1 | 6/2015 | Trapani | |
| 2015/0366272 | A1 | 12/2015 | Wroblewski et al. | |
| 2016/0324220 | A1 | 11/2016 | Shotey | |

* cited by examiner

INTERIOR SLEEVE FOR HOLDING EYEWEAR

FIELD OF THE INVENTION

The invention relates to devices and methods for holding eyewear to clothing articles. More particularly, the invention relates to an article of clothing that allows the wearer to securely hold sunglasses at or near their collar.

BACKGROUND OF THE INVENTION

Many people wear eyeglasses of some form, whether these be reading, long distance or sunglasses and combinations thereof. Often, there is a need to remove or exchange eyeglasses from use and store these temporarily. For example, when the wearer walks from outside to inside on a sunny day. In many cases, the eyeglasses will be folded and the arm of the eyeglasses will be inserted into a collar or pocket. In this case, the lens part of the eyeglasses is located on the outside of the shirt and one of the arms is on the inside of the shirt.

Although the above arrangement may allow for temporary storage of the eyeglasses, there is a risk that the eyeglasses will fall off the shirt and become damaged. For example, this may occur when the user moves around, bends over or when others (such as children) happen to touch or grab at the eyeglasses.

Some solutions to this problem have been envisioned such as an interior pocket on a collar that contains the entire pair of eyeglasses therein. For example, see 2015/0157074 to Trapani which discloses an internal pocket that is generally rectangular in shape and is configured to receive both the arm and lens portion of the eyeglasses. Although this solution can retain the eyeglasses, it results in a rather bulky configuration that would be uncomfortable or may not work for relatively form fitting clothing.

Other solutions to the problem of retaining eyeglasses include metallic clips or loops that are positioned on the exterior of the shirt. Although these configurations may retain the eyeglasses, the exterior positioning can be unsightly and if one were to place these structures on the interior of the shirt, the result would be uncomfortable to the user and the loop would not resist rotation of the eyeglasses in multiple directions or in some desired directions.

SUMMARY OF THE INVENTION

Therefore, it is an object of the present invention to provide a garment that allows the user to securely, easily, discreetly and comfortably hold eyeglass arms to the interior of the shirt.

It is yet another object of the invention to provide a securing system that resists rotation of the eyeglass arm in multiple directions.

These and other objects are achieved by providing an article of clothing for holding eyewear having interior and exterior sides. A sleeve is located on the interior side and extends from an opening, the opening is configured to receive a part of the eyewear. A first section of the sleeve extends from the opening towards a first end at first distance and in a first direction. A second section of the sleeve extends from the first end a second distance and in a second direction with the second direction positioned at an angle relative to the first direction. The sleeve is configured to retain the part of the eyewear therein to hold the eyewear to the article of clothing.

The opening may be a hole in the clothing article such that the hole is adapted to receive the part of the eyewear. The opening may be a collar and the sleeve may be positioned below the collar. The part of the eyewear may include an arm of the eyewear.

In some embodiments a width of the first section of the sleeve is measured perpendicular to the first direction and the width is less than a lens height of the eyewear. A height of the first section is measured along the first direction between the opening and the first end, and the width is less than 25% of the height.

In other embodiments the width is less than 15% of the height and less than 75% of the lens height of the eyewear.

The second section may resist rotation of the eyewear about an axis extending along the first direction by retaining an earpiece section of the part of the eyewear against the interior side of the clothing article. In some embodiments the sleeve is sewn to the interior side of the clothing article and in others the sleeve may be bonded to the interior side of the clothing article. In some embodiments, the sleeve is made of a material more flexible than the clothing article.

In other aspects a method is provided for holding eyewear to an article of clothing. The method may include one or more steps of: providing eyewear having an arm section and a lens section, the arm section defining a temple length and the lens section defining a lens height; providing an article of clothing with a sleeve located on an interior face of the article of clothing, the sleeve having a width that is less than half that of the lens height; and inserting the arm into the sleeve such that the arm is retained in the sleeve and against the interior face of the article of clothing.

In some embodiments the sleeve includes first and second sections, the first section extending in a first direction at a first distance, the second section extending a second distance at an angle relative to the first section. In some embodiments a width of the sleeve measured perpendicular to the first distance is less than 25% of the first distance. The width of the sleeve may also be less than 15% of the first distance.

In some embodiments, the article of clothing includes an opening; and the inserting step includes inserting the arm from an exterior face of the article of clothing and through the opening. In some embodiments a length of the sleeve is at least as large as the temple length.

The sleeve resists rotation of the arm about a lengthwise axis of the arm and the sleeve further resists rotation of the arm about a pivot located between the arm and the lens section. In some embodiments the sleeve is made of a material more flexible than the clothing article.

Other objects of the invention and its particular features and advantages will become more apparent from consideration of the following drawings and accompanying detailed description.

DETAILED DESCRIPTION OF THE INVENTION

Figure 1:
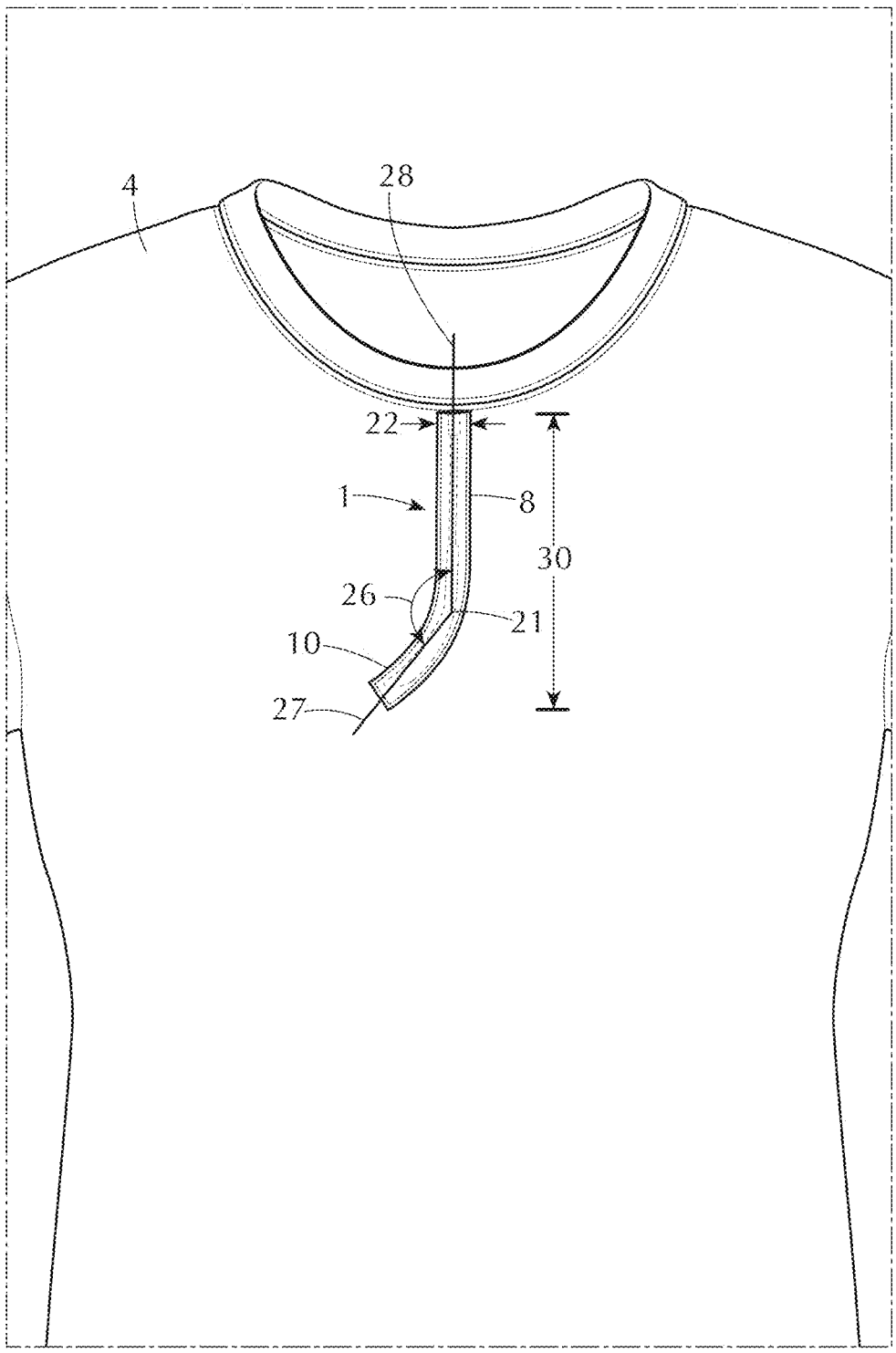
FIG. 1 is an interior plan view of a t-shirt including a sleeve according to one embodiment of the present invention

Referring now to the drawings, wherein like reference numerals designate corresponding structure throughout the views. The following examples are presented to further illustrate and explain the present invention and should not be taken as limiting in any regard.

Figure 5:
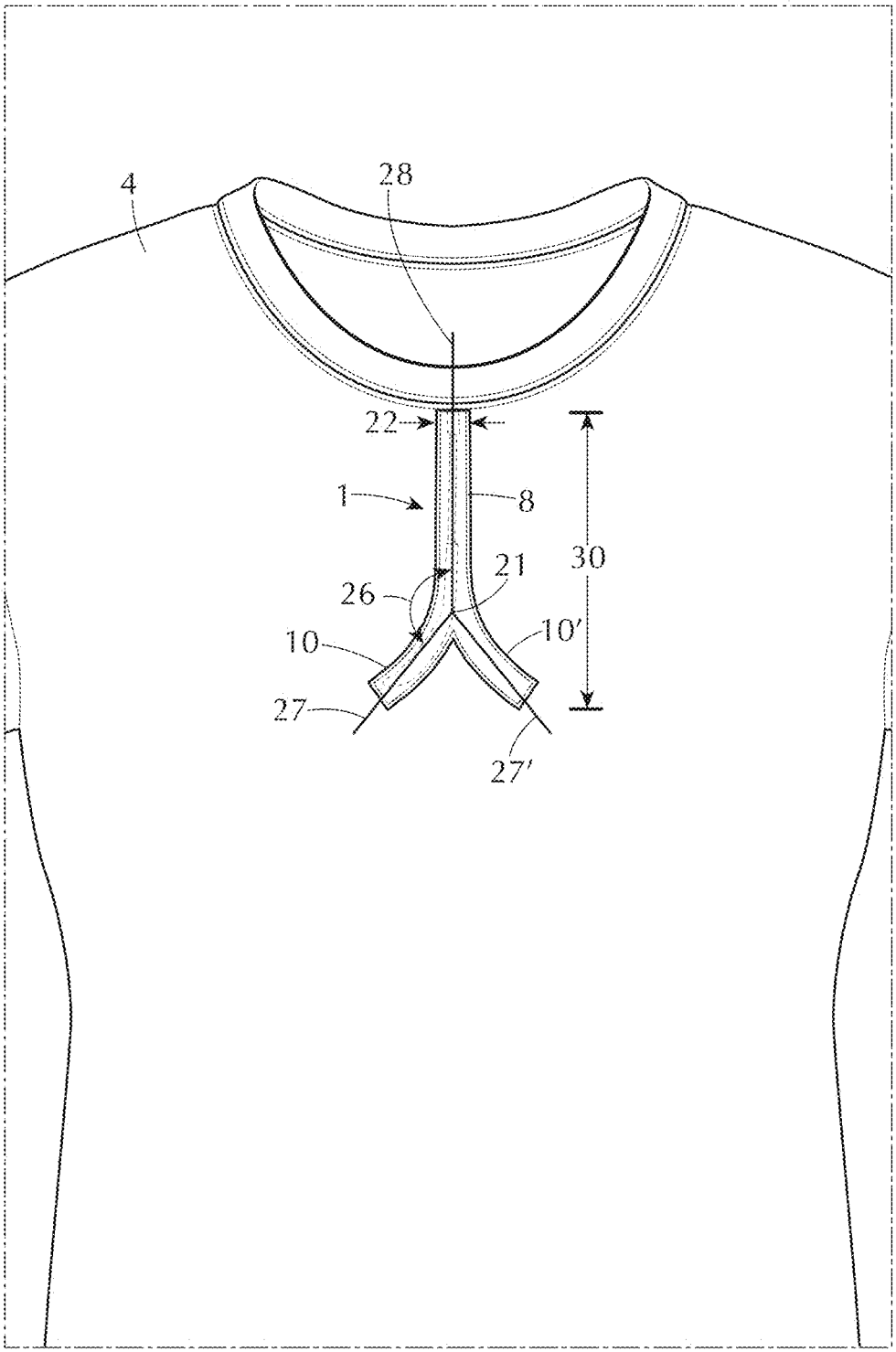
FIG. 5 is an interior plan view of another t-shirt according to one embodiment of the present invention.

The sleeve 1 is positioned in the interior side 4 of a t-shirt. The exterior side 6 of the clothing article 2 of the t-shirt has an opening 3 therein. The opening receives an arm 12 of eyewear such as eyeglasses or sunglasses. The sleeve includes a first section 8 and a second section 10. In the embodiment shown in FIG. 5, a third section 10' can be positioned as a mirror image of section 10 about axis 28. This third section 10' extends along axis 27' that is transverse to both axis 27 and axis 28. This results in the sleeve 1 looking similar to an upside down "Y," The first section extends generally in a vertical direction at a distance 20 to the first end 21 of the first section.

Figure 2:
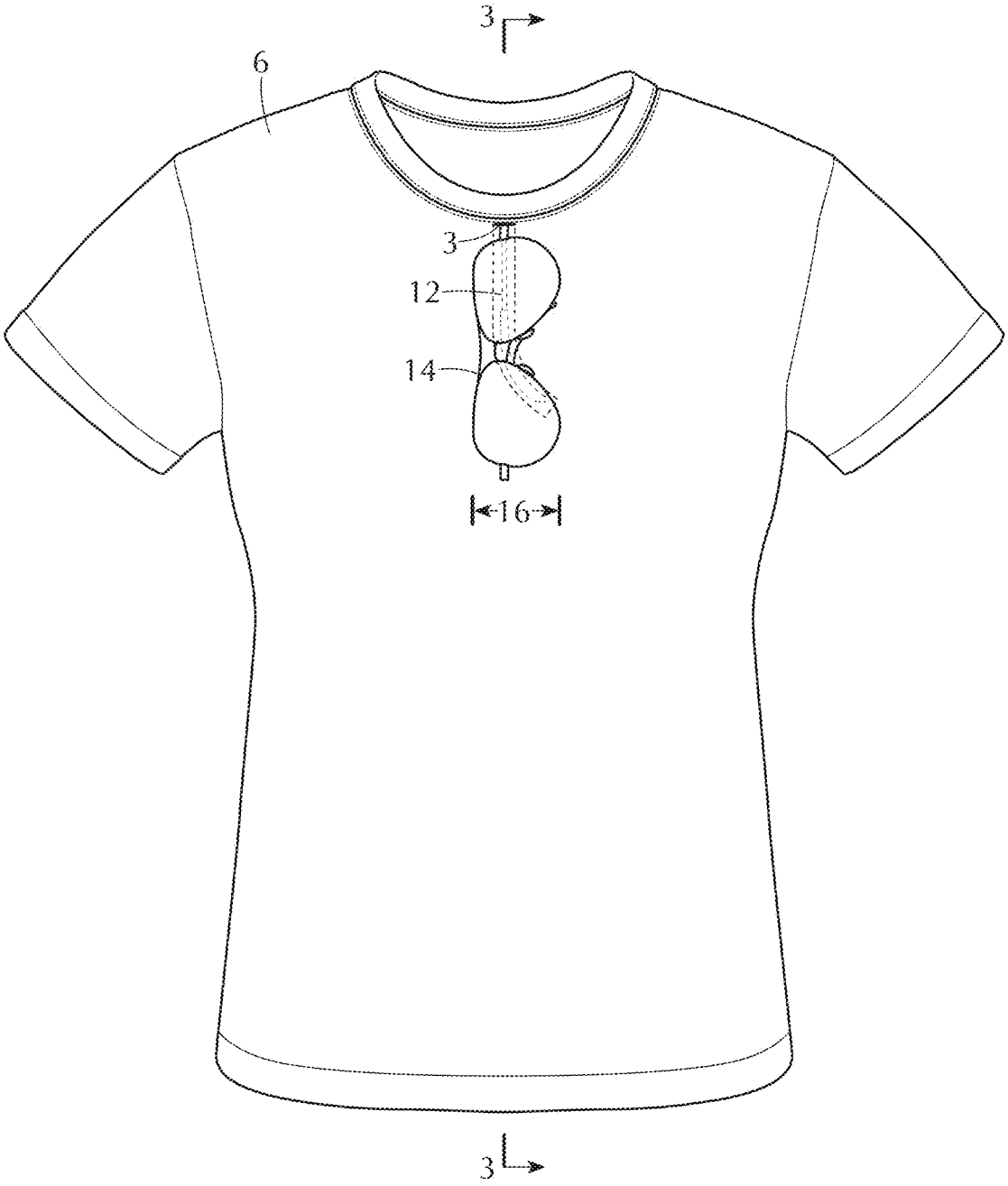
FIG. 2 is an exterior plan view of the t-shirt of FIG. 1.

As shown in FIGS. 1 and 2 the second section 10 extends a distance 24 along a direction that is located at an angle 26 relative to the first section. The angle 26 may be non-constant extending away from the first section (i.e. the second section may be curved) or the angle may be constant such that the first and second sections meet at a sharp angle. In either case, the first and second sections are positioned at angles relative to each other. This creates a sleeve 1 that is generally of the shape of arms of eyewear or able to receive one of the arm therein. For example, arm 12 includes a straight section 13 and an angled section 15. The angled section 15 may also include curved portions. The width 22 of the sleeve 1 is sized to receive the straight section 13 therein and also allow the angled section 15 (earpiece) to be inserted through the first section 8 and ultimately rest in the second section 10.

The mirrored second section (FIG. 5) that results in an upside down "Y" shaped sleeve may be included so that the eyeglasses can be positioned with the left lens or right lens closer to the opening. Depending on the orientation of the eyeglasses, the angled section 15 would extend in different directions and the mirrored second section enables the eyeglasses to be stored in either configuration.

In the embodiment shown, the sleeve 1 is defined by the interior side 4 and a piece of fabric affixed to this interior side 4. The fabric affixed to the clothing article 2 is generally more flexible than the clothing article. This allows the sleeve to flex and expand while the user inserts the arm 12 into the sleeve via the opening 3 and in order to accommodate the angled section 15.

Although second section 10 is shown as generally squared off at the end, the side walls of the second section could taper outwards. This can enable different fits of eyeglasses to fit in the same shirt. For example, eyeglasses are often custom fit such that the earpieces (angled section 15) are bent at custom angles/locations to fit the wearer. Tapered sidewalls of the second section 10 may allow for a more universal fit.

The second section 10 of the sleeve allows for resistance against rotation of the arm about the lengthwise axis 28. As can be seen in FIG. 1, the second section 10 extends away from the lengthwise axis 28 to create a lever. When the arm 12 is inserted into the sleeve, the angled section 15 is positioned in the second section 10. To the extent a rotating force is put upon the eyeglasses that tends to rotate the glasses about lengthwise axis 28, the angled section 15 would press against the interior side 4 of the clothing article 2 or against the opposite interior face 32 of the sleeve at a distance from lengthwise axis 28. This creates an opposing moment to counteract the rotating force which may be due to the wearer's movement or an external force.

The sleeve also resists rotation about the pivot 18 of the eyeglasses. For example, if one were to pull the lens section 14 of the eyeglasses outwards relative to FIG. 2, the arm 12 would tend to try to rotate around pivot 18. Since the arm 12 is retained in the sleeve along the length of the arm, the sleeve resists rotation of the arm 12 and keeps the eyeglasses retained on the t-shirt. The overall length 30 of the sleeve 1 in some embodiments is configured to be at least as large as the length of the arm 12 (temple length).

Figure 3:
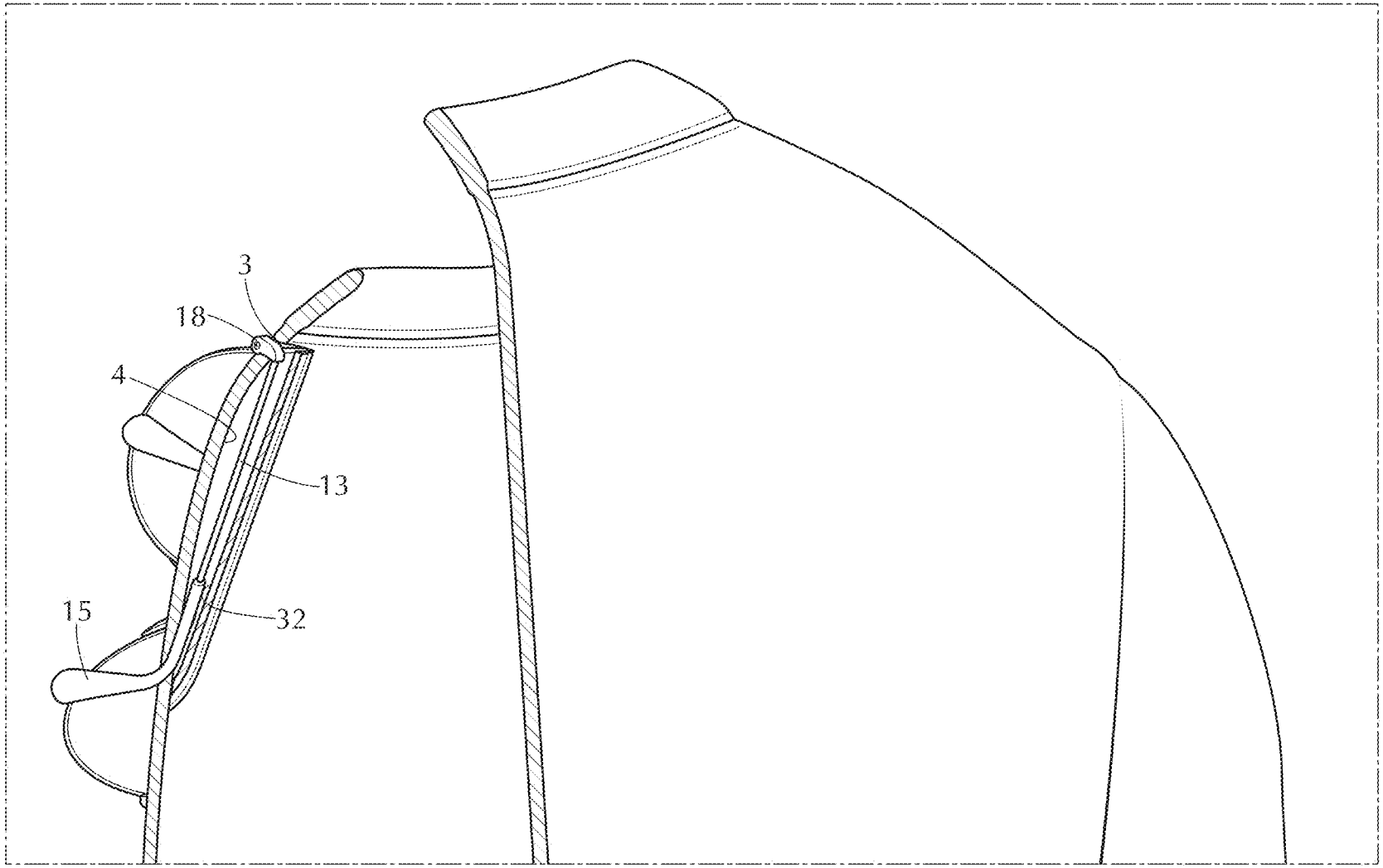
FIG. 3 is a side section view of FIG. 1.
Figure 4:
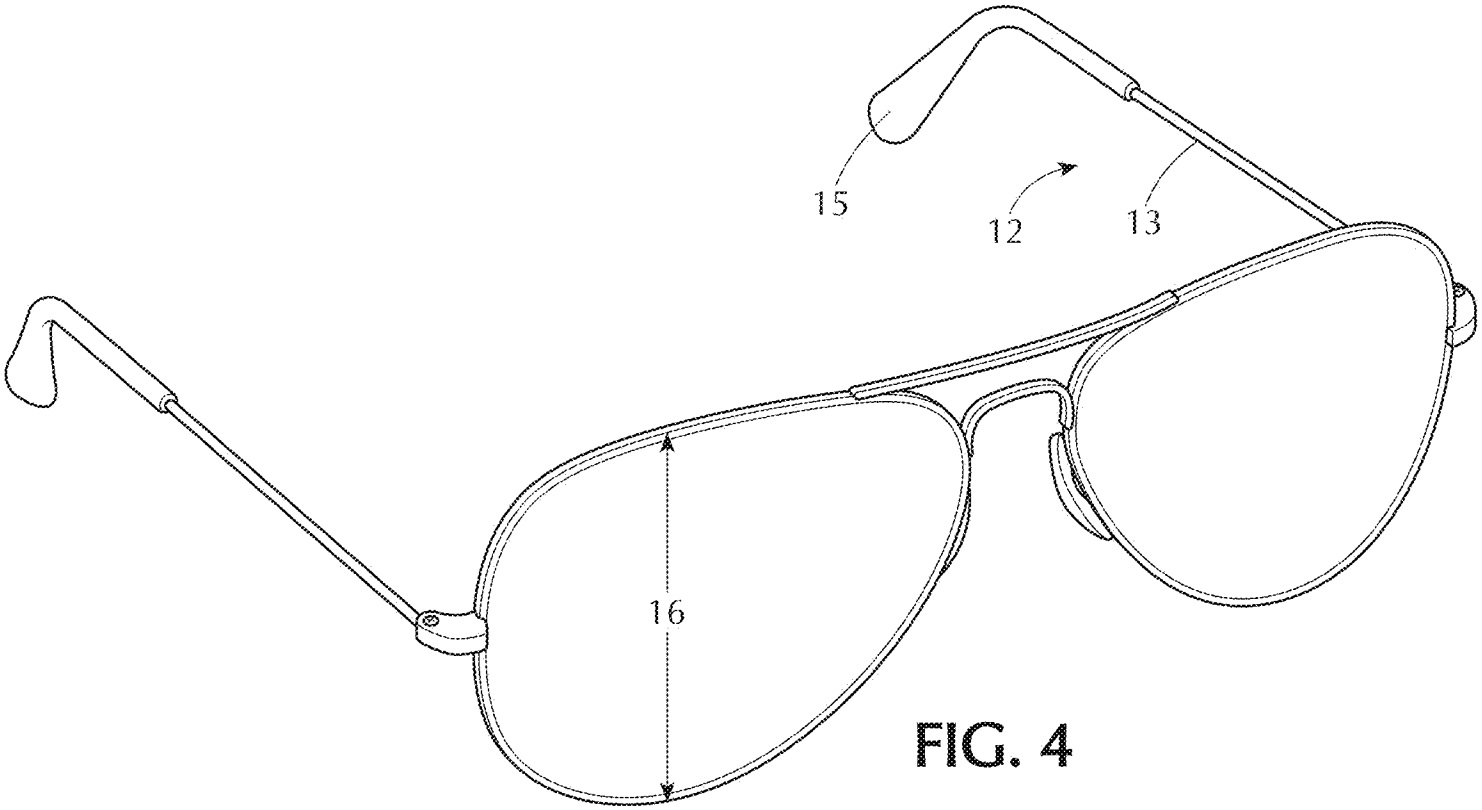
FIG. 4 is a perspective view the sunglasses of FIG. 2 that can be used with the shirt of FIG. 1.

As can be seen in FIG. 3, the sleeve is defined by a combination of the t-shirt and the sewn in fabric that defines the interior face 32 of the sleeve. In the alternative, the fabric could be configured to have one open end like a sock and then be bonded directly to the interior face 6 of the shirt. In this embodiment, the open end of the sock like fabric configuration would be positioned to receive the arm 12 through the opening 3.

The opening 3 is shown positioned directly below the collar. The distance between the collar and the opening is less than the height of the first section. In some aspects, this distance is less than 50% of the height or even more preferably less than 25% of the height. This allows the eyeglasses to be positioned close to the collar and allow the user to appear to have clipped the eyeglasses around the collar using traditional practices, but with the added retention benefits provided by the sleeve as discussed herein.

It is understood that the sleeve described and shown herein can apply to numerous other clothing articles such as, hats, pants, suit jackets, button down shirts, polo shirts, sweaters, and hoodies, to name a few. Typically, when the wearer of the clothing article wishes to store their eyewear using the sleeve, the user provided with a shirt having a sleeve will insert the arm of the eyewear through the opening so that the pivot 18 of the eyewear is relatively close to the opening and the arm is located in the sleeve. This allows the sleeve to retain the arm and securely hold the eyewear to the shirt. The other arm of the eyewear is folded so that it rests between the exterior of the shirt and the lens of the eyewear.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A device for holding eyewear comprising:

a clothing article having interior and exterior sides;

a sleeve located on said interior side and extending from an opening, the opening configured to receive a part of the eyewear;

a first section of said sleeve extending from the opening towards a first end at first distance and in a first direction;

a second section of said sleeve extending from said first end in a second direction, the second direction positioned at an angle relative to the first direction and having a first radius of curvature along at least a majority of the second section; and a third section of said sleeve extending from said first end in a third direction, the third direction transverse to both the first direction and the second direction and having a second radius of curvature along at least a majority of the third section, the third section contacting the second section at a single intersection point, the intersection point being an acute angle axially colinear with the first section;

wherein the sleeve is configured to retain the part of the eyewear therein to hold the eyewear to the article of clothing.

2. The device of claim 1 wherein the opening is a hole in said clothing article and the hole is adapted to receive the part of the eyewear.

3. The device of claim 1 wherein the opening is a collar and the sleeve is positioned below the collar.

4. The device of claim 1 wherein the part of the eyewear includes an arm of the eyewear.

5. The device of claim 1 further comprising:

a width of said first section measured perpendicular to the first direction, wherein said width is less than a lens height of the eyewear:

a height of said first section measured along the first direction between the opening and the first end; and said width is less than 25% of said height.

6. The device of claim 5 wherein said width is less than 15% of said height and less than 75% of the lens height of the eyewear.

7. The device of claim 1 wherein said sleeve is sewn to the interior side of the clothing article.

8. The device of claim 1 wherein said sleeve is bonded to the interior side of the clothing article.

9. The device of claim 1 wherein said sleeve is made of a first material and said clothing article is made of a second material, wherein said first material includes a flexibility that is different than said second material.

10. A device for holding eyewear comprising:

a clothing article having interior and exterior sides;

a sleeve located on said interior side and extending from an opening, the opening configured to receive a part of the eyewear;

a first section of said sleeve extending from the opening towards a first end at first distance and in a first direction;

a second section of said sleeve extending from said first end in a second direction, the second direction positioned at an angle relative to the first direction and having a first radius of curvature along at least a majority of the second section; and a third section of said sleeve extending from said first end in a third direction, the third direction transverse to both the first direction and the second direction and having a second radius of curvature along at least a majority of the third section, the third section contacting the second section at an intersection point, the intersection point being an acute angle axially colinear with the first section; wherein a width of said first section measured perpendicular to the first direction, wherein said width is less than a lens height of the eyewear;

a height of said first section measured along the first direction between the opening and the first end, said width being less than 50% of said height; and a distance measured between a collar opening of said clothing article and the opening of said sleeve is less than said height.

* * * * *